US007364383B2

(12) United States Patent
Fletcher et al.

(10) Patent No.: US 7,364,383 B2
(45) Date of Patent: Apr. 29, 2008

(54) ROLL-UP SURFACE, SYSTEM AND METHOD

(75) Inventors: G. Shane Fletcher, Winchester, VA (US); Edward W. Bindon, Fairfax, VA (US)

(73) Assignee: Ground Floor Systems, LLC, Winchester, VA (US)

( * ) Notice: Subject to any disclaimer, the term of this patent is extended or adjusted under 35 U.S.C. 154(b) by 0 days.

(21) Appl. No.: 11/495,791

(22) Filed: Jul. 28, 2006

(65) Prior Publication Data

US 2006/0285921 A1 Dec. 21, 2006

(51) Int. Cl.
*E01C 5/00* (2006.01)

(52) U.S. Cl. ..... 404/35; 404/40; 404/41; 52/177; 52/592.1

(58) Field of Classification Search ..... 404/34, 404/35, 37, 38, 39, 40, 41; 52/177, 592.1, 52/604

See application file for complete search history.

(56) References Cited

U.S. PATENT DOCUMENTS

| | | | | | |
|---|---|---|---|---|---|
| 358,269 | A * | 2/1887 | Homan | 52/588.1 |
| 3,301,147 | A * | 1/1967 | Clayton et al. | 404/35 |
| 3,377,931 | A * | 4/1968 | Hilton | 404/35 |
| 3,385,183 | A * | 5/1968 | Kortz | 404/35 |
| 3,538,819 | A * | 11/1970 | Petransky et al. | 404/35 |
| 3,572,224 | A * | 3/1971 | Perry | 404/40 |
| 3,611,655 | A * | 10/1971 | Loebner | 52/592.2 |
| 3,859,000 | A * | 1/1975 | Webster | 404/41 |
| 5,527,128 | A * | 6/1996 | Rope et al. | 404/35 |
| 5,833,386 | A * | 11/1998 | Rosan et al. | 404/36 |
| 6,032,428 | A * | 3/2000 | Rosan et al. | 52/592.1 |
| 6,298,524 | B1 * | 10/2001 | Officer | 24/306 |
| 6,769,835 | B2 * | 8/2004 | Stridsman | 404/41 |
| 6,938,382 | B2 * | 9/2005 | Schmitz | 52/89 |
| 7,090,430 | B1 * | 8/2006 | Fletcher et al. | 404/35 |
| 2002/0189183 | A1 * | 12/2002 | Ricciardelli | 52/390 |
| 2003/0037504 | A1 * | 2/2003 | Schwitte et al. | 52/586.1 |
| 2004/0035079 | A1 * | 2/2004 | Evjen | 52/592.1 |

* cited by examiner

*Primary Examiner*—Gary S Hartmann
(74) *Attorney, Agent, or Firm*—Williams Mullen, P.C.; Thomas F. Bergert

(57) ABSTRACT

The present invention provides a ground flooring device, system and method which includes connectable slats or panels having connection means which allow a series of slats to be quickly assembled, rolled up for storage or transport, and unrolled for deployment. The connection means can comprise specially adapted hinge members provided on the edges of the panels for flexible, yet secure attachment. The slats can be secured in a series, and a series of slats can be secured in multiple rows to create a solid, manipulable floor readily deployable on ground areas of virtually any shape.

8 Claims, 5 Drawing Sheets

ROLL-UP SURFACE, SYSTEM AND METHOD

CROSS-REFERENCE TO RELATED APPLICATIONS

This application claims priority under 35 U.S.C. 120 to U.S. non-provisional application Ser. No. 10/874,934, filed Jun. 24, 2004, entitled "Roll Up Surface, System and Method," now issued as U.S. Pat. No. 7,090,430, the disclosure of which is hereby incorporated by reference.

FIELD OF THE INVENTION

The present invention relates to roll-up material surfaces such as portable ground flooring systems, and methods of installing and using the same.

BACKGROUND

Unmodified ground surfaces hinder the ability to set up quick, stable, level and secure environments for a variety of purposes. For example, outdoor field events such as carnivals, corporate outings, wine tastings, mountain bike races and even military deployments often require booths, tents or other structures with solid and stable flooring from which to manage the event. Particularly if computers or other equipment typically found in an indoor workplace environment are required, it becomes almost essential to provide a more stable, strong, level and secure ground flooring capable of rapid deployment and disassembly.

Past efforts attempting to address the above and related challenges have erred in being too heavy, stiff and unmanageable or in being too light, flimsy and incapable of handling heavy and sharp stresses. What is needed is a lightweight, durable, readily portable flooring system that can be quickly deployed in an otherwise unmodified environment. What is further needed is a flooring system that minimizes necessary storage space when not in use or when being transported, while also maintaining sufficient strength overall and at known weak points in prior systems, such as at a seam between flooring panels, for example. What is further needed is a flooring system that can be adapted to various shapes of ground surfaces, including uneven ground.

SUMMARY OF THE PRESENT INVENTION

The present invention provides a ground flooring device, system and method which provides heretofore unknown strength, versatility, lightness of weight, durability, portability and storability. The invention includes connectable slats or panels having connection means which allow a series of slats to be quickly assembled, rolled up for storage or transport, and unrolled for deployment. The slats can be secured in a series, and a series of slats can be secured in multiple rows to create a solid, manipulable floor readily deployable on ground areas of virtually any shape.

The present system can comprise multiple slats or panels secured edge-to-edge by specially adapted hinge members provided on the edges of the panels for flexible, yet secure attachment. In one embodiment, each panel member is made of formed and extruded plastic material or other solid material suitable for the purposes of the present invention. The ground covering systems of the present invention can further have a variety of shapes when constructed, including rectangular, octagonal, circular or other geometric shape. For a given end shape, each panel member can be substantially uniform in size and shape. For example, for the development of a rectangular ground covering, each panel member can be rectangular, and for a circular ground covering, each panel member may be shaped like a piece of pie, such that when adjoined side-by-side with other panel members, a circular ground cover is developed.

The specially adapted hinge members allow the present invention to be securely maintained while also allowing any end developed flooring to be rapidly rolled up for transport and re-deployed. The present invention can be used as flooring for military applications, entertainment and sporting event applications, racing pit and staging area protection applications, landscaping and construction access protection and various other flooring uses. The present invention rolls up for fast set up or take down as well as for compact storage and transport. In one embodiment, the slats or panels can be formed of high-impact plastic which largely conforms to unlevel, rolling ground while maintaining bridging strength for ground discontinuities.

DETAILED DESCRIPTION OF A PREFERRED EMBODIMENT

Figure 1:
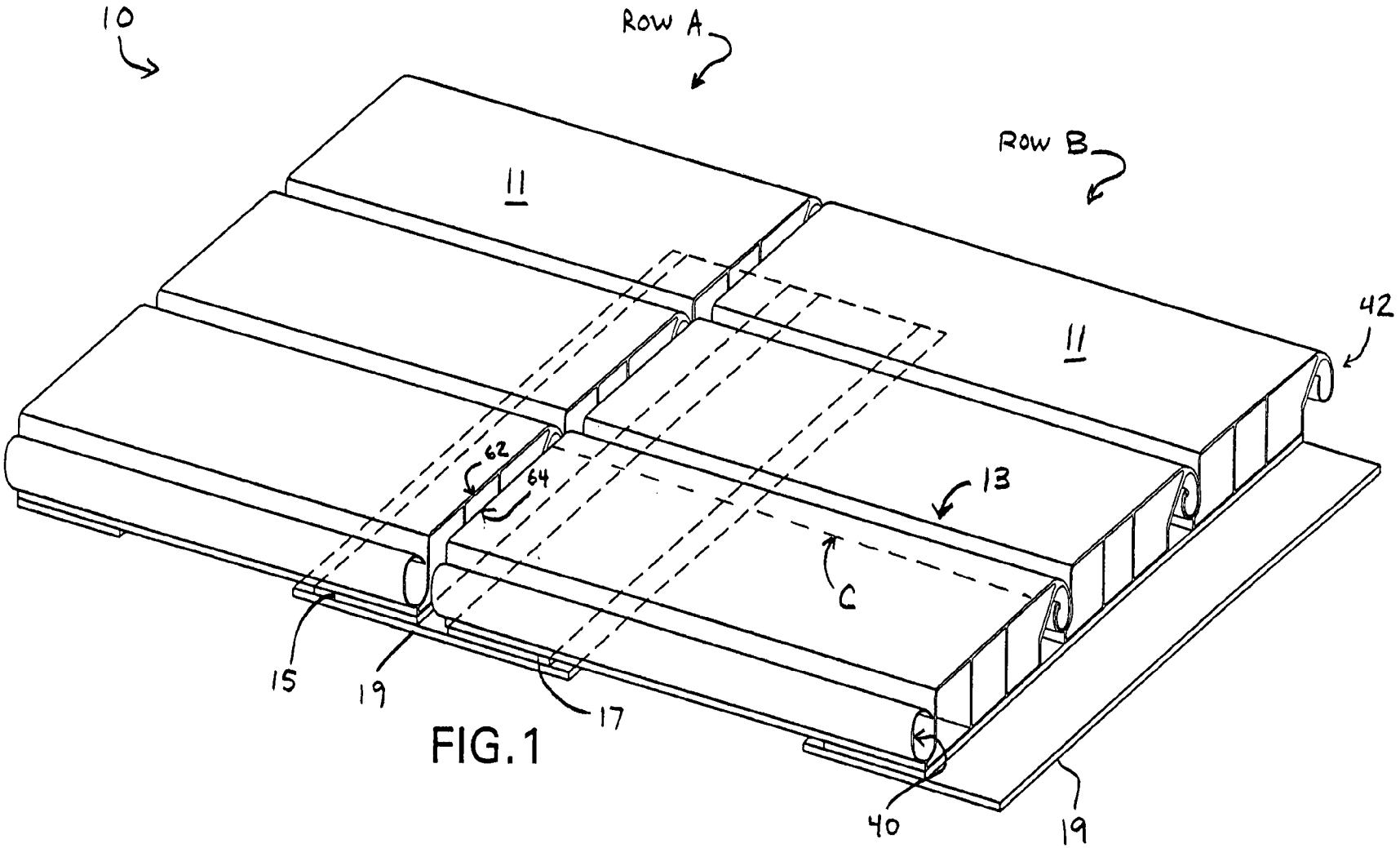
FIG. 1 is a perspective view of two rows of a series of surface panels as provided by the present invention.

FIGS. 1 through 6 show the device, system and method of the present invention in various views. As shown in the perspective view of FIG. 1, the system of the present invention can allow a rectangular flooring 10 to be constructed by aligning multiple panel or slat members 11 edge to edge in parallel rows (e.g., Rows A and B). While FIG. 1 shows a rectangular shape, it will be apparent from the disclosure herein that the present invention can be adapted to suit other shapes as desired, including without limitation circular, polygonal or other shape. Hinge or connector members 40,. 42 associated with the present invention act to secure the panel members horizontally. In one embodiment, the hinge members bring adjacent panels into a tight adjacent fit to give the semblance of a permanent seam 13, which thereby prevents "punch through" of loads which may be borne directly on a given seam.

The panel members can be secured together as rows through the use of "hook" and "loop" type fasteners as well as VHB "very high bond" fastening systems as are generally known in the art. As shown in FIG. 1, for example, loop strips 15, 17 can be secured to the bottom side of rows of panels using VHB material. The VHB material adheres to the bottom of the panels, such that approximately one-half of the width of the loop strip 15 is secured to the bottom of one row of panels (e.g., Row A) and the approximate other half of the width of the loop strip 17 is secured to the bottom of the longitudinally adjacent row of panels (e.g., Row B). In one embodiment of the invention, strips 15 and 17 are 1.5 inches in width. With the strip securely in place, the outwardly facing loop sections are available for mating with a larger "hook" strip 19. As shown in the example in FIG. 1, a hook strip can be wide enough (e.g., 4 inches in width) to secure to two loop strips on adjoining panel rows. In this way, the present invention allows the rows of panel members to be tightly secured.

Figure 2:
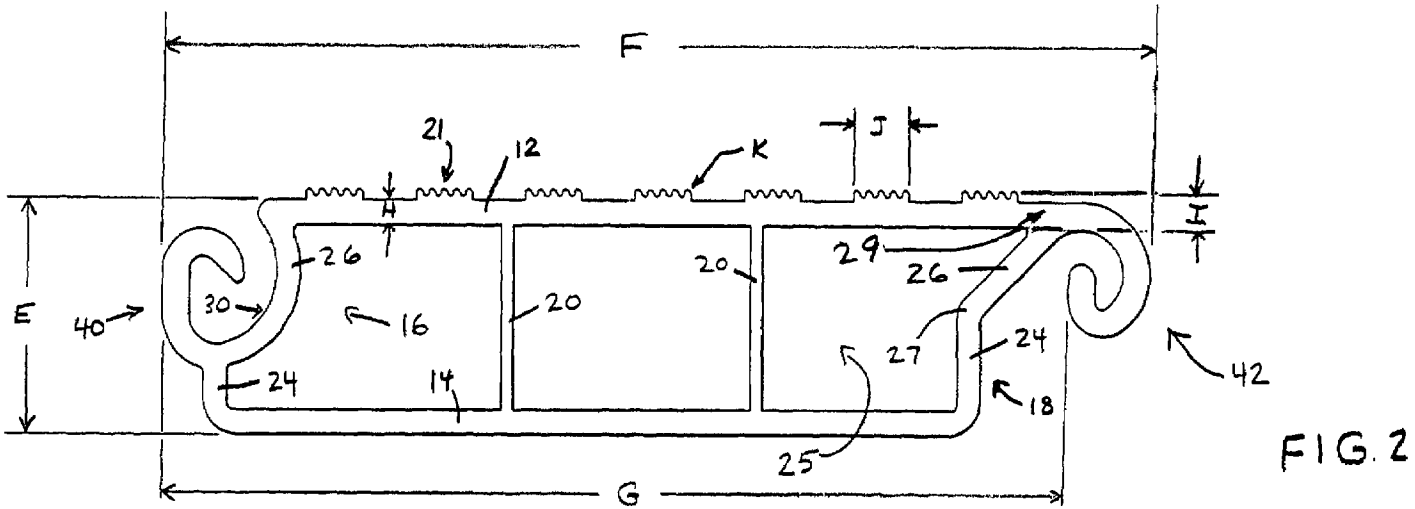
FIG. 2 is a right side view of a single panel as provided by the present invention.
Figure 3:
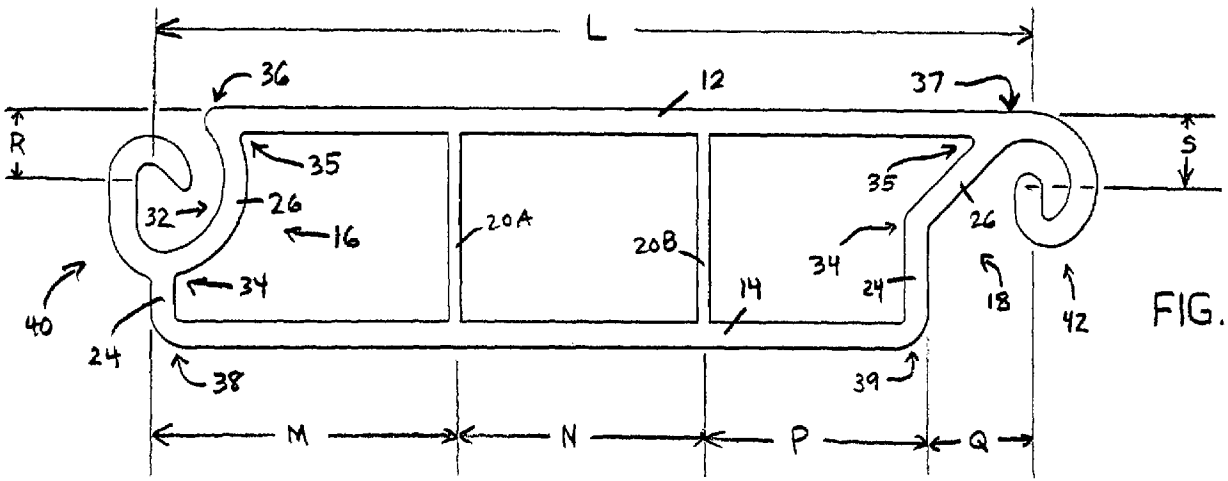
FIG. 3 is a right side view of an alternative embodiment of a single panel element in accordance with one aspect of the present invention.

As shown in FIG. 2, each panel member can have an upper surface provided with appropriate ridges 21 extending substantially parallel to the side edges of the upper wall and substantially for the length of the panel or slat member. The ridges provide for anti-skid surface resistance. This assists the stability and overall applicability of the present invention for deployments where there may be wet surfaces. FIG. 3 shows an embodiment of the present invention without ridges on the upper wall 12.

As shown in FIGS. 2 and 3, each panel or slat member 11 is provided with a first side hinge or connector member 40 and a second side hinge or connector member 42. As shown in FIGS. 2 through 5, the hinge members can be provided with specific dimensions to assist in yielding a stable strong attachment. Each panel or slat member can further be provided with one or more guide rails for vertical support and end caps (80 in FIG. 7) made of nylon or other suitable material. In one embodiment, the panels are joined by aligning the edges of two panels and sliding the panels together so as to inter-connect their respective hinge members (see FIG. 1). In another embodiment, panels are joined by pushing or snapping the hinge members together. These attachment methods are described more completely below.

As shown in FIGS. 1 through 3, each slat 11 has a length and a width and substantially parallel upper 12 and lower 14 walls. Each slat further has side walls 16 and 18. Side walls and upper and lower walls create an internal opening 25 extending the length of the slat and through the slat so as to make the slat hollow and decrease its weight. Such openings 25 also allow the flooring system of the present invention to securely retain a lightweight flooring bag, roll tie and/or wiring that might be employed with electrical devices in a particular deployment of the present invention. One or more interior walls 20 can also be provided, which extend substantially the length of the slat to add internal stability to the slat.

The side walls each have lower 24 and upper 26 portions extending substantially the length of the slat. The lower portion 24 of side walls 16, 18 is integrally formed with, extends from, and is generally perpendicular to the lower wall 14. The lower portions 24 are substantially parallel to one another and the upper portions 26 are substantially non-parallel. As shown in FIGS. 2 and 3, the upper portion 26 of one side wall 16 is generally curved or arcuate when viewed from the side so as to form a concave exterior segment 30 of the exterior surface 32 of the side wall 16. It will be appreciated that the right side view of panel members shown in FIGS. 2 and 3 is substantially similar to the cross-sectional view. As also shown in FIGS. 2 and 3, the upper portion 26 of the opposite side wall 18 is generally linear when viewed from the side and/or in cross-section and extends from the top 27 of the lower portion 24 of side wall 18 to the edge 29 of upper wall 12.

In one embodiment, the upper 12 and lower 14 walls can be substantially the same width. As shown in FIG. 3, the upper wall 12 and side walls 16, 18 meet at respective upper wall edges 36, 37. Similarly, the lower wall 14 and side walls 16, 18 meet at respective lower wall edges 38, 39. In one embodiment, the upper wall edges 36, 37 and lower wall edges 38, 39 are not vertically coplanar. This assists in the support of respective connector members and in the articulation features of the present invention as more completely described below.

As shown in FIGS. 2 through 5, hinge or connector members 40, 42 act as an attachment mechanism for attaching a pair of slats together so that one side wall 16 of a first slat 11 is hingedly connected to an opposite side wall 18 of another slat. In one embodiment, this connection is continuous for the length of the side walls. In one embodiment of the invention, the connector members 40, 42 are integrally formed with and extend from respective upper portions 26 of the side walls 16, 18. Connector members permit relative rotation of each of the first and second slats about an axis (e.g., C in FIG. 1) substantially parallel to the side walls.

As shown in FIG. 3, the wall upper portions 26 have a lower edge 34 integrally formed with a respective one of the side wall lower portions 24 and an upper edge 35 integrally formed with a respective edge 36, 37 of the upper wall 12. Connector member 40 extends from the lower edge 34 of the upper portion 26 of the first side wall 16, and connector member 42 extends from the upper edge 36 of the upper portion 26 of the second side wall 18. The connector members 40, 42 form a substantially C-shape or hook-shape in side view and/or in cross section, although this shape can be different as between the two connector members as shown in FIGS. 2 through 5.

Figure 4:
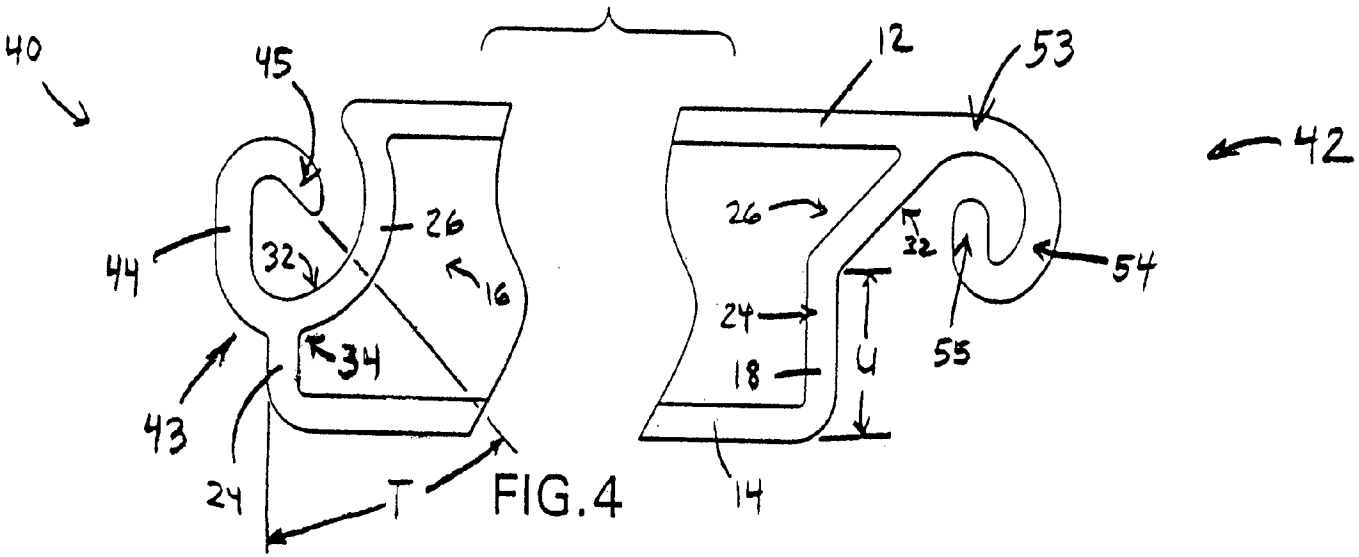
FIG. 4 is a partial right side view of connector members and other portions of a panel member in accordance with one embodiment of the present invention.
Figure 5:
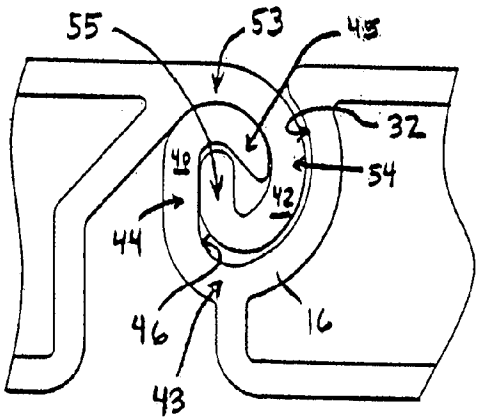
FIG. 5 is a partial right side view showing engaged connector members of two panels in accordance with one aspect of the present invention.

As shown in FIGS. 4 and 5, connector member 40 has a base portion 43 extending outwardly away from the exterior face 32 of side wall 16 generally at the lower edge 34 of the upper portion 26 of the side wall 16. Connector member 40 bends back upon itself to form a middle portion 44 which extends substantially parallel to the lower portion 24 of the first side wall 16. Connector member further bends back so as to have a tip section 45 extending toward the exterior face 32 of side wall 16.

As shown in FIGS. 4 and 5, connector member 42 has a base portion 53 extending outwardly away from said the exterior face 32 of side wall 18 so as to be substantially coplanar with the upper wall 12. Connector member 42 bends back upon itself so as to form a middle portion 54, which is generally arcuate in side view and/or cross section, and a tip portion 55. As shown in FIGS. 4 and 5, tip portion 55 extends substantially parallel to the lower segment 24 of side wall 18 and further extends toward the base portion 53 of connector member 42.

As shown in FIG. 5, the exterior surface 32 of side wall 16 and the interior surface 46 of connector member 40 form an engagement surface for tip portion 55 of connector 42. Similarly, the interior surface 46 of connector member 42 forms an engagement surface for tip portion 45 of connector member 40. In one embodiment of the invention, connector members 40, 42 are integrally formed, respectively, with side walls 16, 18 and extend substantially the length of the side walls. As shown in FIG. 3, connector member 40 extends from a point near the outermost edge 37 of upper wall and connector member 42 extends generally from a point near the outermost edge 38 of lower wall so as to receive additional support. At least in part, the upper and lower walls are provided in substantially equal length but with edges in non-vertical planes in order to provide such support, as the connector members are subjected to repeated interaction in the deployment and attachment of the flooring system of the present invention.

By way of example only and with reference to FIGS. 2 through 4, elements of the present invention can be provided with approximate dimensions as follows. As shown in FIG. 2, height E can be approximately 0.50 inches, external width F can be approximately 2.24 inches, and width G from outside of connector member 40 to the inside of connector member 42 can be approximately 2.06 inches. As shown in FIG. 2, wall thickness H can be approximately 0.050 inches, wall thickness I including ridge 21 can be approximately 0.065 inches. Ridge width J can be approximately 0.125 inches, and individual ridge elements can have a radius K of 0.007 inches. As shown in FIG. 3, width measurement L can be approximately 2.00 inches, width measurement M to first interior wall 20A can be approximately 0.68 inches, width measurement N between first 20A and second 20B interior walls can be approximately 0.56 inches, width measurement P between second interior wall 20B and side wall 18 can be approximately 0.53 inches, and width measurement Q can be approximately 0.23 inches. As further shown in FIG. 3, distance R can be approximately 0.15 inches, and distance S can be approximately 0.16 inches. As shown in FIG. 4, angle T can be approximately forty-five (45) degrees and distance U can be approximately 0.25 inches.

Figure 6:
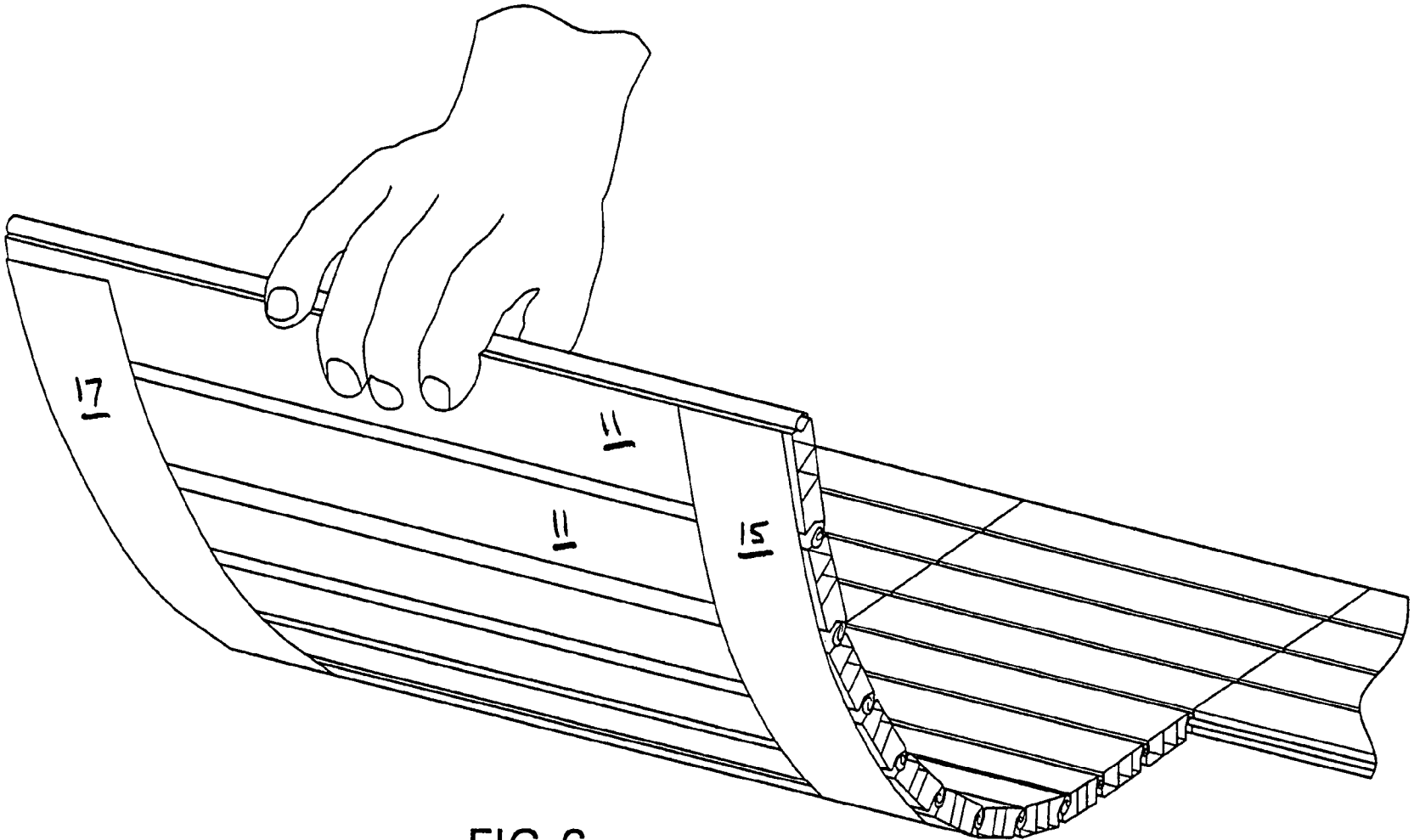
FIG. 6 is a perspective view of a series of panels connected and rolled up in accordance with a method of the present invention.

When connector members 40, 42 are engaged, as shown in FIG. 5, the slats can be articulated and/or rotated towards and away from each other while maintaining connectivity (see FIG. 6). The connector members are dimensioned, angled and contoured so as to provide greater flexibility and articulation in one rotational direction and less flexibility in the other. In one embodiment, when rolled such that the lower surfaces or walls of the slats rotate towards each other and therefore face the interior of the roll, rotation of one slat aligned next to another can be permitted up to approximately 45 degrees. In this way, a series of slats 11 can be easily rolled and unrolled during deployment, as shown in FIG. 6. In another embodiment, when rolled such that the upper surfaces or wall of the slats rotate towards each other and therefore face the interior of the roll, rotation of one slat next to another can be permitted from an angle of at least approximately 10 degrees to an angle of at least approximately 28 degrees. Providing rotation to different degrees allows the present invention to capably accommodate uneven ground surfaces, and further minimizes the trapping of dirt and mud on the lower walls of the assembled surface of the flooring.

The connector members 40, 42 can become engaged by sliding adjacent panel members together so as to interlock the connector members, or by snapping the connector members together with sufficient force to temporarily displace the connector members to allow room for the interlocking to take place. The slats or panels can be disconnected from one another using the reverse process.

As shown in FIG. 1, slats can be joined side by side in a row (e.g., Row A) as well as end 62 to end 64 in adjoining rows (e.g., Row A and B) by various securing methods. In a particular embodiment, hook and loop strips are used as described above and as shown in FIG. 1. Importantly, adjoining multiple rows of slats does not negatively impact the rotatability or rollability of the flooring, as a plurality of rows of slats can be rotated and/or rolled together.

Figure 7:
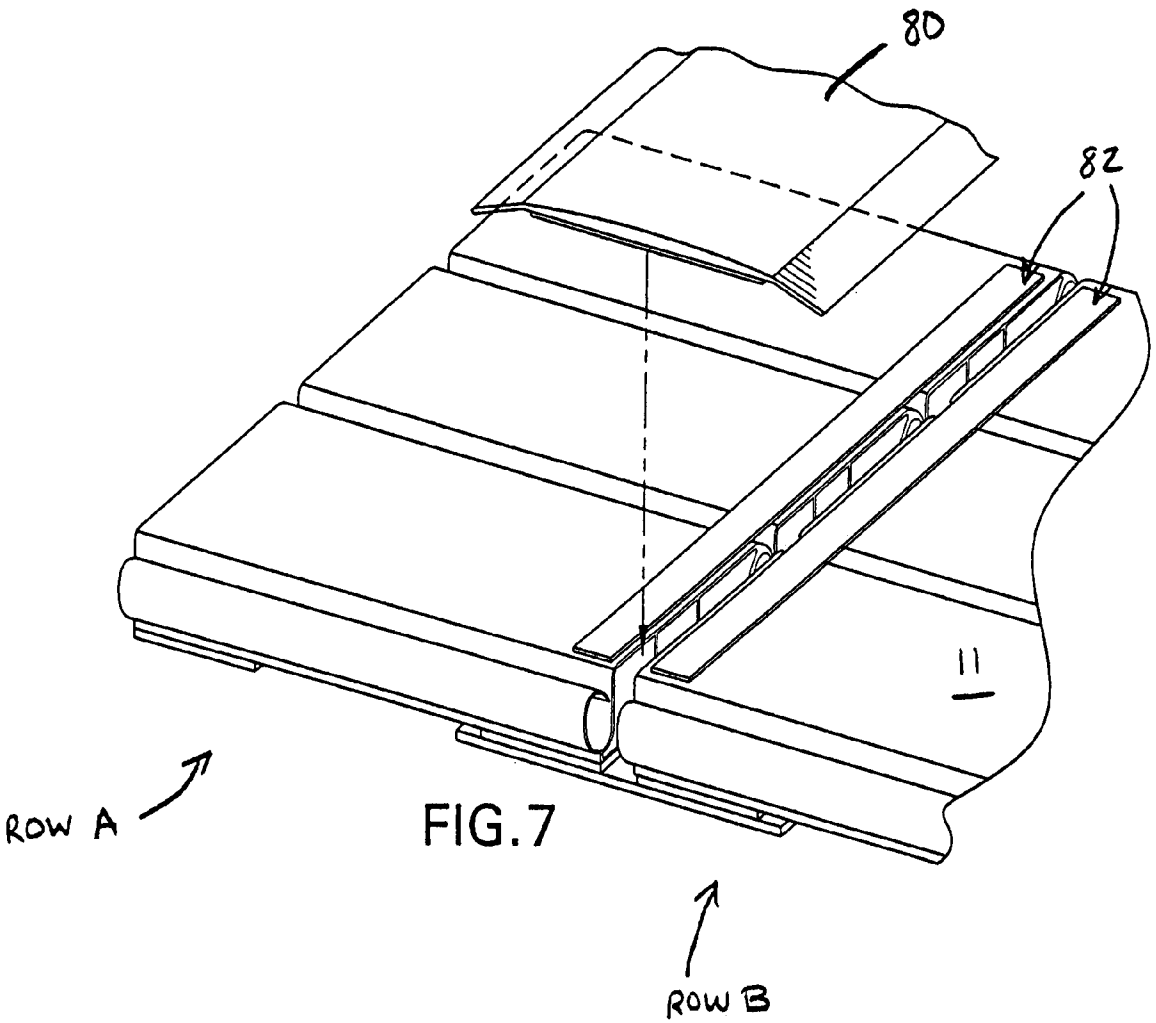
FIG. 7 shows a perspective view of two rows of connected panels with a seam cap, in accordance with the present invention.

In one embodiment of the invention, the present invention can be assembled and deployed as follows. First, a plurality of panels or slats are obtained and either slidingly engaged or snappingly engaged edge to edge using opposing connector members. Next, the series of slats can be provided with bonding elements, such as VHB material towards each outer, narrower end of each slat, and a loop strip attached to the VHB material so as to run the entire width of the assembled series on or near each end. The addition of VHB material and loop strips can occur on both the upper and the lower sides of the series of panels. Next, an adjoining row of similarly assembled panels can be aligned end-to-end with the first series of panels, and secured together using a wider "hook" strip on the bottom side of the panels as described above. Lastly, a seam cap 80 with appropriate hook strip can be placed atop loop strips 82 on the upper or top side of the panels, as shown in FIG. 7. While FIGS. 1 and 7 show the bonding elements on the outside of the lower walls of the panels for securely attaching adjacent rows of panels, and on the outside of the upper walls of the panels for receiving cap member 80, it will be appreciated that a single bonding arrangement on the upper or lower surfaces can be employed.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed and desired to be secured by Letters Patent is:

1. A flooring, comprising:

a first and second slat, each slat having a length, substantially parallel upper and lower walls, and first and second side walls;

said first side wall and said second side wall each further having a connector member extending outwardly therefrom substantially for the length of the side wall, said connector members being generally hook-shaped in cross-section, and wherein at least one of said connector members has a base portion and bends back upon itself so as to form an arcuate portion in cross section and a tip portion, wherein the tip portion extends towards said base portion, for attaching said first and second slats so as to permit relative rotation of each of said first and second slats about an axis parallel to the side walls while maintaining connectivity between the slats.

2. The flooring of claim 1 wherein said first side wall connector member has a portion which is substantially parallel to at least a portion of said first side wall, and wherein said second side wall connector member has a portion which is substantially parallel to at least a portion of said second side wall.

3. The flooring of claim 1 wherein the connector members permits snapping engagement of said slats.

4. The flooring of claim 1 wherein the connector members permits sliding engagement of said slats.

5. The flooring of claim 1 wherein each slat is hollow and further includes at least one interior wall support integrally formed with said upper and lower walls and extending the length of said slat.

6. The flooring of claim 1 wherein said first and second slat form a first row of slats having a first end and a second end, and wherein a second row of slats is formed substantially identical to said first row of slats, and wherein said flooring further includes securing means for securing said first and second row of slats together such that said first end of said first row of slats cooperatively engages said second end of said second row of slats, thereby permitting said relative rotation of first and second slats of each of said row of slats in tandem.

7. The flooring of claim 6 wherein said securing means includes a first bonding element extending laterally across each of said first and second row of slats at a location near said first end of said first row of slats and at a location near said second end of said second row of slats, and wherein said securing means further includes a second bonding element for engaging said first bonding element.

8. A method of providing a roll-up surface, comprising:

providing a first and second slat, each slat having a length, substantially parallel upper and lower walls, and first and second side walls;

providing said first side wall and said second side wall each with a connector member extending outwardly therefrom substantially for the length of the side wall, said connector members being generally hook-shaped in cross-section, and wherein at least one of said connector members has a base portion and bends back upon itself so as to form an arcuate portion in cross section and a tip portion, wherein the tip portion extends towards said base portion, for attaching said first and second slats so as to permit relative rotation of each of said first and second slats about an axis parallel to the side walls while maintaining connectivity between the slats.

* * * * *